US009256156B2

(12) United States Patent
Goto et al.

(10) Patent No.: US 9,256,156 B2
(45) Date of Patent: Feb. 9, 2016

(54) DEVELOPING ASSEMBLY, PROCESS CARTRIDGE, AND IMAGE-FORMING APPARATUS

(71) Applicant: CANON KABUSHIKI KAISHA, Tokyo (JP)

(72) Inventors: Gosuke Goto, Kawasaki (JP); Masato Koyanagi, Ibaraki (JP); Kazutoshi Ishida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/459,639

(22) Filed: Aug. 14, 2014

(65) Prior Publication Data

US 2015/0055989 A1 Feb. 26, 2015

(30) Foreign Application Priority Data

Aug. 23, 2013 (JP) ..... 2013-173702

(51) Int. Cl.
*G03G 15/08* (2006.01)

(52) U.S. Cl.
CPC ..... *G03G 15/081* (2013.01); *G03G 15/0812* (2013.01); *G03G 15/0818* (2013.01); *G03G 2221/163* (2013.01)

(58) Field of Classification Search
CPC ..... G03G 15/0808; G03G 15/0806; G03G 15/0812; G03G 15/0818
See application file for complete search history.

(56) References Cited

U.S. PATENT DOCUMENTS

| | | | | | |
|---|---|---|---|---|---|
| 3,754,963 | A | * | 8/1973 | Chang | 430/101 |
| 4,788,570 | A | * | 11/1988 | Ogata et al. | 399/283 |
| 4,937,167 | A | * | 6/1990 | Moffat et al. | 430/137.12 |
| 5,220,383 | A | * | 6/1993 | Enoki et al. | 399/285 |
| 5,315,061 | A | * | 5/1994 | Suzuki et al. | 399/239 |
| 5,379,097 | A | * | 1/1995 | Aoto et al. | 399/222 |
| 5,879,848 | A | * | 3/1999 | Kurose et al. | 430/107.1 |
| 6,952,551 | B2 | | 10/2005 | Koyanagi et al. | |

(Continued)

FOREIGN PATENT DOCUMENTS

| | | | |
|---|---|---|---|
| JP | 3162219 | B2 | 4/2001 |
| JP | 3272056 | B2 | 4/2002 |
| WO | 2013/128551 | A1 | 9/2013 |

OTHER PUBLICATIONS

Gosuke Goto, et al., U.S. Appl. No. 14/459,630, filed Aug. 14, 2014.

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

First and second dielectric portions and colored particles have −polarity, and a regulating portion and an externally added particles have +polarity. In a triboelectric series,(−)<second dielectric portion<first dielectric portion<regulating portion (+) and (−) colored particles<second dielectric portion<first dielectric portion<externally added particles (+). With work functions, the difference between the colored particles and the second dielectric portion<the difference between the second dielectric portion and the externally added particles, the difference between the colored particles and the first dielectric portion<the difference between the first dielectric portion and the externally added particles, and the difference between the colored particles and the regulating portion>the difference between the regulating portion and the externally added particles.

17 Claims, 13 Drawing Sheets

(56) References Cited

U.S. PATENT DOCUMENTS

| | | | | |
|---|---|---|---|---|
| 7,239,832 | B2 | 7/2007 | Takashima et al. | |
| 7,457,554 | B2 | 11/2008 | Matsuda et al. | |
| 7,711,279 | B2 | 5/2010 | Matsuda et al. | |
| 7,853,171 | B2 * | 12/2010 | Matsui | G03G 15/0815 399/120 |
| 2002/0022188 | A1 * | 2/2002 | Hashimoto et al. | 430/108.1 |
| 2003/0095814 | A1 * | 5/2003 | Miyakawa et al. | 399/252 |
| 2013/0223891 | A1 * | 8/2013 | Koyanagi et al. | 399/279 |

* cited by examiner 4
41
5
32
31
B 1
32
B
A
31
E

B
5
32
31
E
6

DEVELOPING ASSEMBLY, PROCESS CARTRIDGE, AND IMAGE-FORMING APPARATUS

BACKGROUND OF THE INVENTION

1. Field of the Invention

The present invention relates to a developing assembly that is used for an image-forming apparatus based on an electrophotographic system.

2. Description of the Related Art

A developing assembly, that does not include a developer supply member, has been proposed to downsize and reduce cost of a developing assembly. The developer supply member has a function to supply and scrape off developer (hereafter called "toner") to/from a developing roller (developer bearing member), and is installed mainly for handling a ghost and a solid image follow-up failure. A ghost is a phenomenon that appears when a half tone image is formed after a high density solid image is formed, where the traces of the solid image appear on the half tone image. A solid image follow-up failure is a phenomenon that appears when a 100% solid image is drawn on the entire surface of an image, where the density of the rear end of the image decreases. Therefore in order to omit the developer supply member, these problems must be handled by a different means. In Japanese Patents Nos. 3272056 and 3162219, a developing assembly that does not include a developer supply member is proposed, where dielectric portions and conductor portions are regularly or irregularly mixed and distributed on the surface of a developing roller. In other words, the dielectric portion on the surface of the developing roller is rubbed by a toner layer thickness regulating member (developer regulating member) directly or via toner, whereby the dielectric portion is charged and a minute closed electric field is formed on an adjacent part with the conductor portion. The toner conveyed to the surface of the developing roller is subject to the gradient force generated by the minute closed electric field, is sucked to and borne on the surface of the developing roller.

According to Japanese Patents Nos. 3272056 and 3162219, if the charging polarity of toner is negative, the developing assembly is constructed such that (−) toner<developer regulating member<dielectric portion (+) is established in a triboelectric series. By this configuration, multilayer toner can be borne on the surface of the developer roller, and the generation of a solid image follow-up failure can be suppressed.

However the inventors discovered that if the dielectric portion is positioned to the side closer to the opposite polarity of the charging polarity of the toner than to the developer regulating member on the triboelectric series, as in the case of Japanese Patents Nos. 3272056 and 3162219, a ghost is easily generated. In the configuration of the prior art, toner borne by the dielectric portion strongly adheres to the dielectric portion electrostatically, therefore regulating the toner layer thickness is difficult, and the toner coating amount on the developing roller, when the solid white image is formed, becomes higher compared with the case of forming a solid image. This difference in the toner coating amount may appear in the image as a ghost. Further, the developer regulating member has only the function to adjust the coating amount, and has no scraping off function, hence if a low printing page is continuously outputted, toner may melt and adhere to the developing roller. Furthermore, toner may melt and adhere to the developer bearing member since the developer supply member has no scraping off function, and the dielectric portion is charged to a polarity that is opposite that of the toner. To avoid these image defects due to the melt adhesion of toner, the life of the developing assembly in some cases may be set to be short.

SUMMARY OF THE INVENTION

It is an object of the present invention to provide a technique that allows better image formation in an image-forming apparatus.

To achieve the above object, the typical configuration disclosed in the present patent application comprising:

a container that contains developer including colored particles and externally added particles dispersed on the surface of the colored particles;

a developer bearing member that bears the developer; and a regulating portion that regulates a layer thickness of the developer borne by the developer bearing member, wherein a first dielectric portion and a second dielectric portion are disposed on a surface bearing the developer in the developer bearing member, and the regulating portion, the first dielectric portion and the second dielectric portion have the following relationships:

concerning charging polarity, the first dielectric portion and the second dielectric portion have a same polarity as the colored particles, and the regulating portion and the externally added particles have opposite polarities;

concerning triboelectric series, the second dielectric portion is located between the colored particles and the first dielectric portion, and the first dielectric portion is located between the second dielectric portion and the externally added particles, and the second dielectric portion is located between the colored particles and the first dielectric portion, and the first dielectric portion is located between the second dielectric portion and the regulating portion; and concerning work functions, the difference between the colored particles and the second dielectric portion is smaller than the difference between the second dielectric portion and the externally added particles, the difference between the colored particles and the first dielectric portion is smaller than the difference between the first dielectric portion and the externally added particles, and the difference between the colored particles and the regulating portion is greater than the difference between the regulating portion and the externally added particles.

Further features of the present invention will become apparent from the following description of exemplary embodiments (with reference to the attached drawings).

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

EXAMPLE 1

<Image-forming Apparatus>

Figure 13:
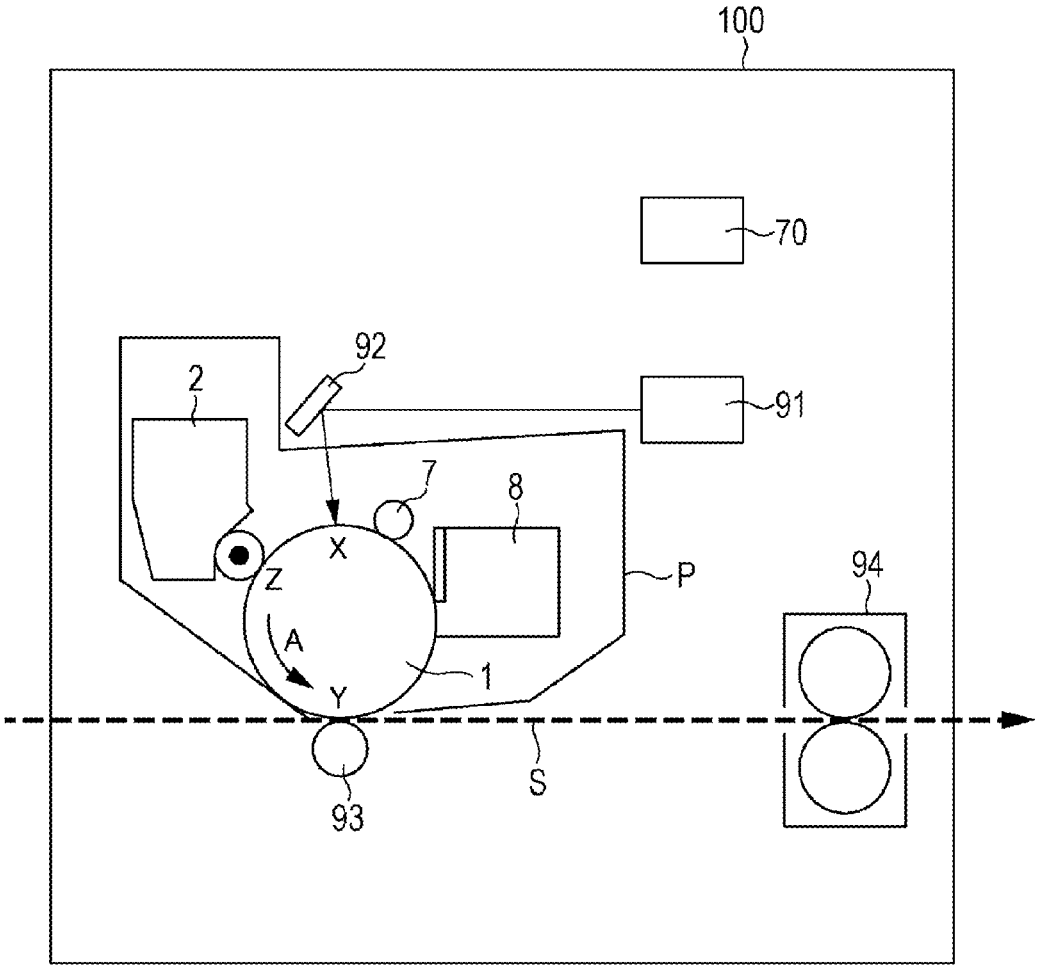
FIG. 13 is a schematic cross-sectional view of an image-forming apparatus according to an example.

FIG. 13 shows a general configuration of an image-forming apparatus 100 according to an example of the present invention. Here the image-forming apparatus (electrophotographic image-forming apparatus) is for forming an image on a recording material (recording medium) by developer (toner) using the electrophotographic image forming process. For example, [the image-forming apparatus] includes an electrophotographic copier, an electrophotographic printer (e.g. an LED printer, a laser beam printer), an electrophotographic facsimile device, an electrophotographic word processor, and a composite machine thereof (multifunction printer). The recording material is a recording medium on which an image is formed, such as recording paper, an OHP sheet, a plastic sheet and cloth. As a major configuration, the image-forming apparatus 100 of this example includes a photosensitive drum 1, a developing assembly 2, a cleaning apparatus 8, a charging roller 7, an exposure apparatus 91, a transfer roller 93 and a fixing unit 94. The photosensitive drum 1, the developing assembly 2, the cleaning apparatus 8 and the charging roller 7 are integrated as a process cartridge P, which is detachable from the image-forming apparatus main body (portion of the image-forming apparatus 100 that remains after the process cartridge P is detached). As the process cartridge, another configuration may be used, where the electrophotographic photosensitive drum, and at least one process unit out of charging apparatuses, a developing unit, and a cleaning unit that works on the electrophotographic photosensitive drum, are integrated into one cartridge. The developing assembly 2 may be a stand alone unit that is detachable from the apparatus main body or the process cartridge P. The developing assembly 2 includes toner that has negative normal charging polarity to develop an electrostatic latent image. (The normal charging polarity of the toner is negative in this example, since an electrostatic latent image with negative polarity is reversal-developed.)

The exposure apparatus 91 and a reflective mirror 92 are disposed so that the laser beam emitted from the exposure apparatus 91 reaches an exposure position X on the photosensitive drum 1 via the reflective mirror 92. The transfer roller 93 is disposed in the lower part of the photosensitive drum 1. A transfer material S after transfer is sent to the fixing unit 94. The cleaning apparatus 8 is installed downstream in the moving direction of the photosensitive drum from the transfer position. The attachment blade is disposed such that toner on the photosensitive drum 1 can be scraped off.

An image forming operation of the image-forming apparatus will now be described. A controller unit 70 comprehensively controls the following image forming operation according to a predetermined control program or reference table. First the surface of the photosensitive drum 1, which is rotating in the arrow A direction at 100 mm/sec, is charged to a predetermined potential by the charging roller 7. In the exposure position X, an electrostatic latent image is formed on the photosensitive drum 1 by the laser beam, which is emitted from the exposure apparatus 91 in accordance with an image signal. The formed electrostatic latent image is developed in a developing position Z by the developing assembly 2 so that the toner image is formed. The toner image formed on the photosensitive drum 1 is transferred to a transfer material S at a transfer position Y. The transfer material S, which is a recording medium on which the toner image is transferred, is sent to the fixing unit 94. The fixing unit 94 pressurizes and heats the toner image on the transfer material S so that the toner image is fixed on the transfer material S, and the final image is formed.

Figure 1:
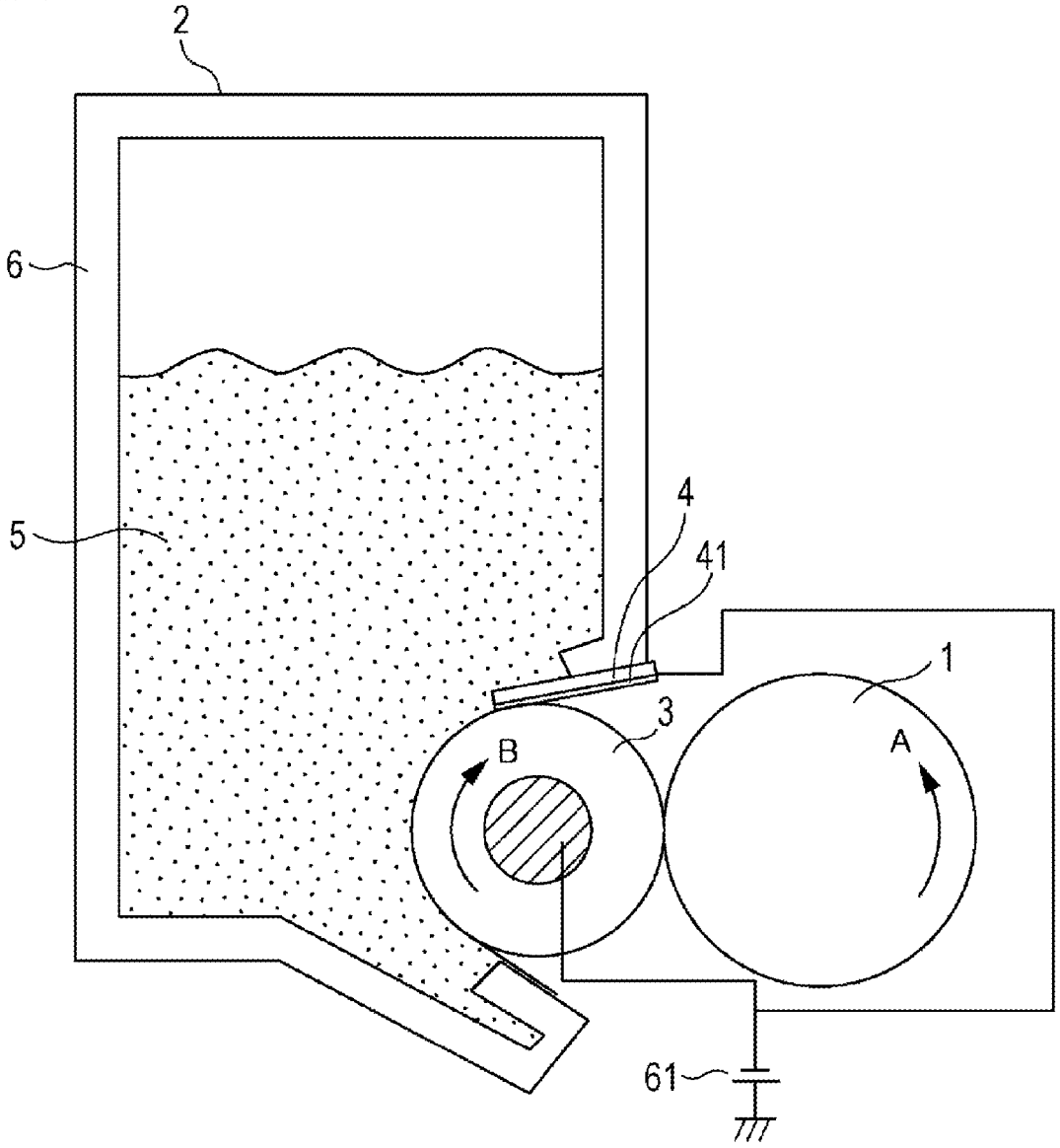
FIG. 1 is a schematic cross-sectional view of a developing assembly according to Example 1.

FIG. 1 shows a general configuration of the developing assembly 2 according to this example. The photosensitive drum 1, as an image bearing member, has a 24 mm outer diameter and is rotary-driven in the arrow A direction at a 150 mm/sec circumferential velocity. The developing assembly 2 is disposed to the left of the photosensitive drum 1. A known charging unit, exposure unit, transfer separation apparatus (transfer unit), cleaning unit and fixing apparatus (none of these are illustrated in FIG. 1) are disposed around the photosensitive drum 1 to execute the electrophotographic process.

As illustrated in FIG. 1, the developing assembly 2 of this example includes a developer container 6, a developing roller 3 and a metal blade (regulating blade) 4. The developer container 6 contains toner 5, which is non-magnetic one-component developer, and the developing roller 3 is rotary-driven in the arrow B direction at 180 mm/sec. A developing bias is applied to the developing roller 3 from a high voltage power supply 61. In this example, the developing roller 3 is disposed contacting the surface of the photosensitive drum 1. The metal blade 4 functions as a regulating portion that regulates the layer thickness of toner on the developing roller. The metal blade 4 includes a charging layer 41, and has the functions of a charge applying unit that applies predetermined charges to the dielectric portion on the developing roller 3 via the toner 5, and a developer charging unit that applies predetermined charges to the toner 5.

The developing assembly 2 of this example has a configuration, which does not include a toner supply member, that contacts the developing roller 3, hence the above mentioned gradient force is used to bear the multilayer toner on the surface of the developing roller 3. For this, a high resistance dielectric portion 31 and an intermediate resistance dielectric portion 32, which have work functions that are different from each other, are disposed on the surface of the developing roller 3, and the dielectric portions are charged to different potentials by rubbing of the metal blade 4 via the toner, whereby a minute closed electric field is formed on the adjacent part of each dielectric portion. The toner conveyed to the surface of the developing roller 3 receives the gradient force by the minute closed electric field, and is sucked to and is borne on the surface of a developer bearing member.

Figure 2:
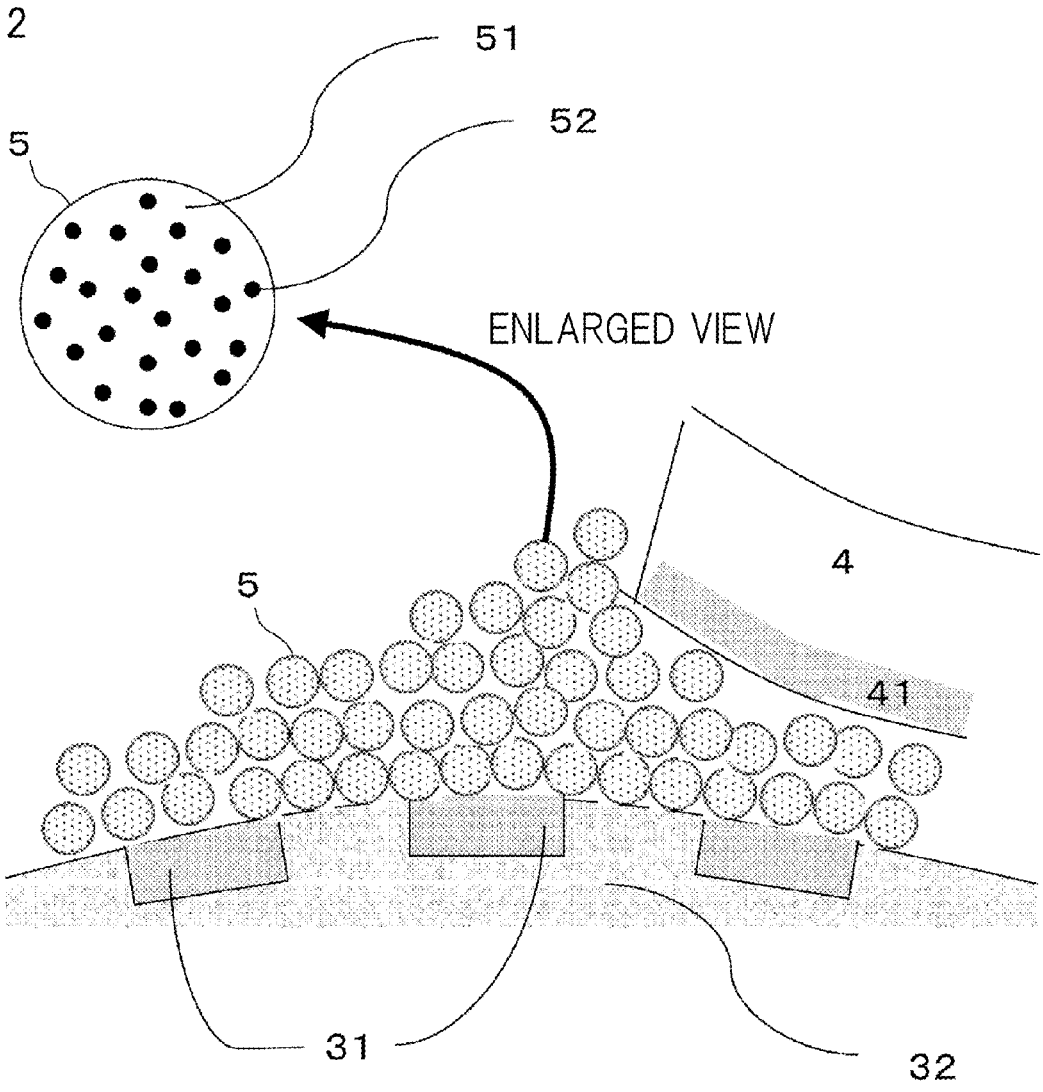
FIG. 2 is a schematic diagram depicting the configuration of toner and externally added particles according to Example 1.

As illustrated in FIG. 2, this example uses toner 5, where externally added particles 52 are dispersed on the surface of the colored particles 51. In this example, mono-dispersion spherical silica is used for the externally added particles 52, and the toner 5 is prepared by stirring a 0.5 parts mass of externally added particles with respect to a 100 parts mass of colored particles at high-speed, so as to process the colored particles 51. The developing system of this example utilizes the relationship of the work functions of the high resistance dielectric portion 31, intermediate resistance dielectric portion 32, colored particles 51 and externally added particles 52 on the surface of the developing roller 3 (details will be described later).

Figure 3A:
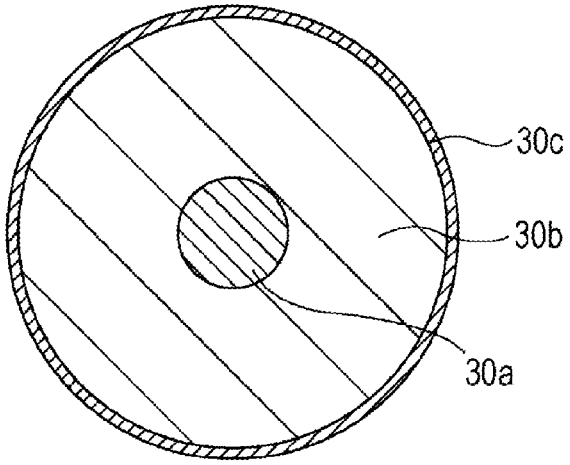
FIGS. 3A to 3C show schematic diagrams depicting the configuration of a developing roller according to Example 1.
Figure 3B:
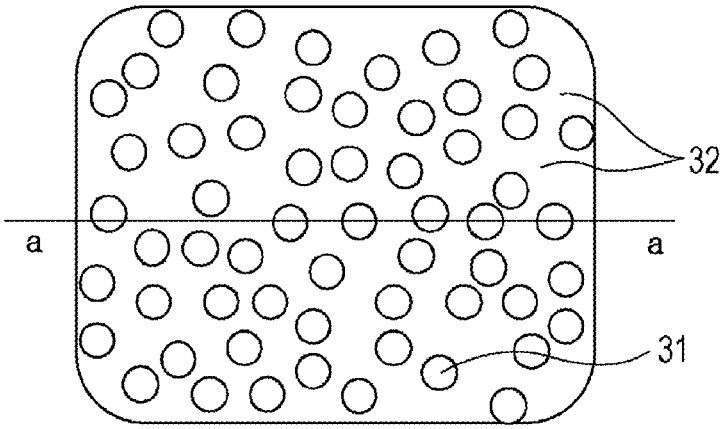
Figure 3C:
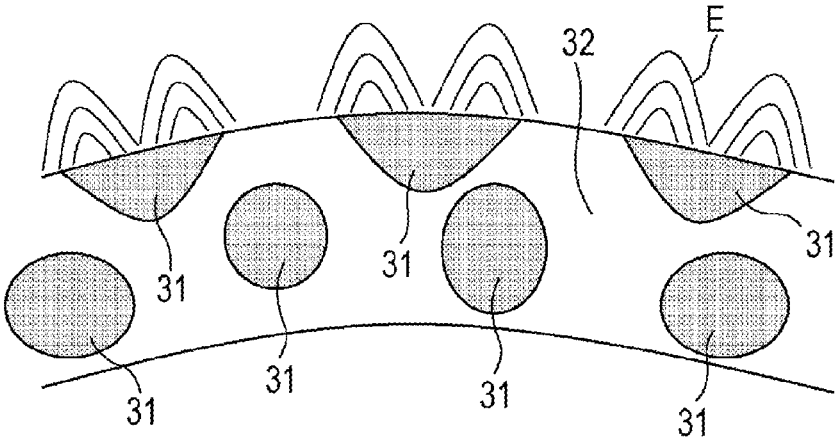

For the developing roller 3 of this example, a developing roller constructed such that the high resistance dielectric portion 31 that can hold charges on the surface, and the intermediate resistance dielectric portion 32 where charges can be held to a certain degree but decay, are exposed in minute areas, is used. In concrete terms, as illustrated in FIG. 3A, the developing roller 3 is constituted by an elastic layer (conductive substrate) 30*b* made of conductive rubber material and a surface layer 30*c*, which are on the outer periphery of a shaft core 30*a*. The surface layer 30*c* is constructed such that a plurality of high resistance dielectric portions 31 (second dielectric portions) are scattered on the surface of the intermediate resistance dielectric portion 32 (first dielectric portion). The developing roller 3 can be fabricated by the surface layer 30*c*, which is made of intermediate resistance resin material in which high resistance dielectric particles are dispersed, being formed (e.g. coated) on the elastic layer 30*b*, polishing the surface. FIG. 3B is a plan view of the developing roller 3, and FIG. 3C is a cross-sectional view sectioned at the a-a line in FIG. 3B. By charging the high resistance dielectric portions 31 by a predetermined method, minute closed electric fields (micro-fields) are formed as the electric lines of force E in FIG. 3C.

The size of the high resistance dielectric portion 31 (size of the portion (circular portion) exposed to the circumferential surface of the developing roller 3 (intermediate resistance dielectric portion 32)) has about a 5 to 500 μm outer diameter, for example. This is an optimum value to hold charges on the surface and suppress image unevenness. If the outer diameter is less than 5 μm, the potential level held on the surfaces of the high resistance dielectric portion 31 and the intermediate resistance dielectric portion 32 is low, and a sufficient minute closed electric field cannot be generated. If the outer diameter is greater than 500 μm, the potential difference between the high resistance dielectric portion 31 and the intermediate resistance dielectric portion 32 increases, and an uneven image is generated.

Figure 4:
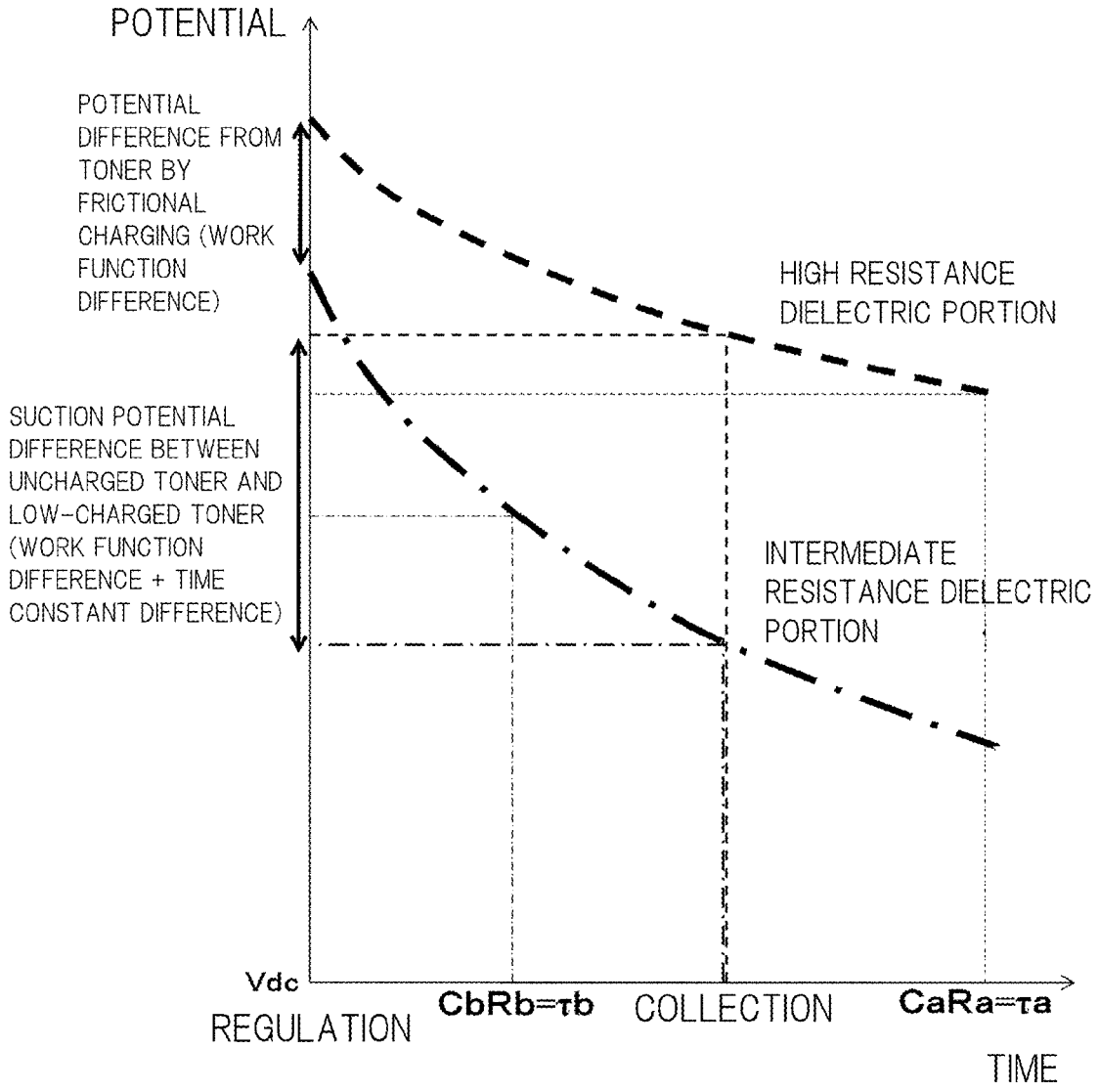
FIG. 4 is a diagram for explaining the relationship between the potential of the developing roller dielectric portion and time according to Example 1.

The charging amount of each dielectric portion also depends on the difference of the work functions from that of the externally added particles 52 on the surface of the toner 5 contacting each dielectric portion. Furthermore, each dielectric portion is constituted by a material having a mutually different time constant and a different potential decaying speed. FIG. 4 shows a state of decaying of each dielectric portion with respect to the charging potential and time. The high resistance dielectric portion 31 and the intermediate resistance dielectric portion 32 have the same polarity, but are charged to mutually different potentials due to rubbing with the externally added particles 52 on the surface of the toner 5 in the regulating portion, due to the above mentioned relationship of the work functions, and move to the developing position in the state where the minute closed electric field is formed. Then each dielectric portion moves to the collection position and enters the developer container 6 again. While moving from the regulating position to the collection position, the potential charged in each dielectric portion decays along the curve shown in FIG. 4. The developing roller 3 is an RC circuit, hence if the time constants of the potentials charged in the high resistance dielectric portion 31 and the intermediate resistance dielectric portion 32 are $\tau a$ and $\tau b$ respectively, then $\tau a = RaCa$ and $\tau b = RbCb$. Here the time constant refers to an index to indicate the response speed of the circuit (that is, the time required for the potential to decay down to a specific ratio), R denotes the resistance component of the dielectric portion, which is an electric resistance value, and C denotes a capacitance component of the dielectric portion, which is an electrostatic capacitance. In this example, each dielectric portion is configured such that $\tau a > \tau b$, that is $RaCa > RbCb$ is established. Then it takes time for the potential of the high resistance dielectric portion to decay (decay does not easily occur). In other words, even if the potential of each dielectric portion decays along the path from the regulating portion to the collection position, the absolute value of the potential of the high resistance dielectric portion 31 can be maintained to be higher than the absolute value of the potential of the intermediate resistance dielectric portion 32. Each dielectric portion can enter the developer container 6 in the collection position while maintaining the minute closed electric field between the high resistance dielectric portion 31 and the intermediate dielectric portion 32, and can suck and bear the uncharged or low-charged toner by the gradient force (details described later).

Further, after the toner layer thickness is regulated by the metal blade 4, the intermediate resistance dielectric portion 32 must have potential when the development cycle T of the developing roller 3 elapses, and also the intermediate resistance dielectric portion 32 must maintain the minute closed electric field. Therefore it is preferable that the electric resistance value Rb and the electrostatic capacitance value Cb of the intermediate resistance dielectric portion 32 satisfy $CbRb \geq T/Ln10$ (Ln: natural logarithm) with respect to the development cycle T of the developing roller 3. Then the intermediate resistance dielectric portion 32, charged by a predetermined method, can maintain at least 10% of the charge amount after T elapses. In this example, this relationship is satisfied and the minute closed electric field is generated by setting $CR \geq 0.091$.

The volume resistivity of the dielectric particles was measured by applying a 1000V voltage to the measurement target sample for 30 seconds under a 23° C./50% RH environment using a Hiresta-UP® resistance measuring apparatus made by Mitsubishi Chemical Corporation. The amount of the measurement target sample to be used is preferably adjusted considering the density of the measurement target particles and the like, and to measure acrylic resin particles, for example, 0.6 g of acrylic resin particles, compressed by applying 2000 kgf/cm$^2$ pressure, are used as the measurement target sample. The specific dielectric constant of the dielectric particles is measured as follows. First the powder sample is placed in a cylinder of which base area is 2.26 cm$^2$, and the upper and lower electrodes are pressurized at 15 kg. At the same time, AC voltage (1 Vpp, 1 MHz) is applied and current is normalized to calculate the specific dielectric constant. To measure CR of the dielectric portion 31 on the surface of the developing roller 3, the dielectric portion 31 may be charged by a predetermined method, and the decay rate thereof may be measured. For example, a measurement sample, of which surface is 1 cm×1 cm and thickness is 3 mm, is extracted from the developing roller 3, and + ions are emitted to the sample by a Zerostat®3 gun made by MILTY Corporation. Then the potential of the dielectric portion 31 is measured at a predetermined time interval in KFM mode by a scanning probe microscope (SPA 300 made by SII Nanotechnology Corporation), and CR is calculated from the potential decay rate.

To form the surface layer 30*c* shown in FIG. 3, acrylic resin particles are dispersed in the intermediate resistance urethane resin as a binder. In this example, the content of the acrylic resin particles is set to 70 parts mass with respect to 100 parts mass of urethane resin, so that the area ratio of the high resistance dielectric portion/intermediate resistance dielectric portion becomes about 50% of the entire area. In this example, a contact developing system is used, and it is preferable, so that the photosensitive drum 1 is not damaged, that the developing roller 3 is an elastic roller where the JIS hardness measured from the surface is in a 30 to 70 degree range. The method of forming the minute high resistance dielectric portion 31 and intermediate resistance dielectric portion 32 is not limited to the above method, but can be various other methods.

Although details will be described later, the developing system of this example uses the relationship of the work functions of the high resistance dielectric portion 31 and the intermediate resistance dielectric portion 32 on the surface of the developing roller 3, the charging layer 41 of the metal blade 4, the colored particles 51 and the externally added particles 52. The work functions of the materials (acrylic resin, urethane) used for the high resistance dielectric portion 31 and the intermediate resistance dielectric portion 32 on the surface of the developing roller 3 were 5.77 eV and 5.6 eV when measured with a 250 nW irradiation light quantity using a surface analyzer (AC-2 type made by Riken Keiki Co., Ltd.).

For the metal blade 4 in this example, polyamide resin is laminated onto the 0.1 mm thick phosphor bronze metal thin plate to form the charging layer 41. The work function of the charging layer 41 measured at 250 nW irradiation light quantity using the surface analyzer (AC-2 type, made by Riken Keiki Co., Ltd.) is 5.42 eV.

Toner 5 used in this example is formed such that colored particles 52 are dispersed on the surface of the negatively charged colored particles 51, which are generated by coloring the non-magnetic styrene-acrylic+polyester resin by pigments. In this example, mono-dispersion spherical silica is used for the externally added particles 52, and the developer is prepared by stirring 0.5 parts mass of externally added particles with respect to 100 parts mass of colored particles at high-speed so as to process the surface of the toner. The work functions of the colored particles 51 and the externally added particles 52 based on the above measurement method are 6.01 eV and 5.01 eV.

By using the materials having the above mentioned work functions in this example, the high resistance dielectric portion 31, the intermediate resistance dielectric portion 32 and the colored particles 51 can be charged to have negative polarity, and the charging layer 41 of the metal blade 4 can be charged to have positive polarity.

As the developing bias for contact development, a −300 V DC voltage is applied to the developing roller 3 from the high voltage power supply 61, which functions as the voltage applying unit. The photosensitive drum 1 is a negatively charged organic photoconductor (OPC), and is designed so that the latent image has −500 V in the solid white image area and −100 V in the solid image area. In order to acquire a satisfactory image density in this example, a 0.54 mg/cm$^2$ toner coating amount is required on the photosensitive drum 1 when the solid image is formed, and for this, a 0.45 mg/cm$^2$ toner coating amount is required on the developing roller 3.

The colored particles 51 and the externally added particles 52 are constructed in this example, where (−) colored particles 51<high resistance dielectric portion 31<intermediate resistance dielectric portion 32<externally added particles 52 (+) is established in a triboelectric series by selecting materials of the colored particles 51 and the externally added particles 52, so as to have the above mentioned work functions. Further, as mentioned above, the charging layer 41 is constructed so that (−) colored particles 51<high resistance dielectric portion 31<intermediate resistance dielectric portion 32<charging layer 41 (+) is established in a triboelectric series. Each material of the colored particles 51, the externally added particles 52, the charging layer 41 of the regulating portion, the high resistance dielectric portion 31 and the intermediate resistance dielectric portion 32 is constituted so as to simultaneously satisfy the following (1) to (3): (1) the difference of the work functions between the colored particles 51 and the high resistance dielectric portion 31 is smaller than the difference of the work functions between the high resistance dielectric portion 31 and the externally added particles 52; (2) the difference of the work functions between the colored particles 52 and the intermediate resistance dielectric portion 32 is smaller than the difference of the work functions between the intermediate resistance dielectric portion 32 and the externally added particles 52; and (3) the difference of the work functions between the colored particles 51 and the charging layer 41 of the regulating member is greater than the difference of the work functions between the charging layer 41 of the regulating member and the externally added particles 52.

By the friction between each dielectric portion 31 and 32 and the externally added particles 52, and between the colored particles 51 or the externally added particles 52 and the charging layer 41, generated because of this configuration, negative polarity charges can be applied to the colored particles 51 and each dielectric portion 31 and 32, and positive polarity charges can be applied to the charge layer 41 and the externally added particles 52. In other words, the colored particles 51 and the externally added particles 52 have mutually opposite polarities in the toner 5.

The colored particles 51 charged to negative polarity and the externally added particles 52 charged to positive polarity that constitute toner 5 behave as particles that are charged to negative polarity since the parts by mass of the colored particles 51 that are charged to negative polarity is sufficiently greater than the parts by mass of the externally added particles 52 that are charged to positive polarity.

Now the developing system of this example will be described with reference to FIG. 5 (solid image formation) and FIG. 6 (solid white image formation). In this example, all the toner 5 on the developing roller 3 is used for development to form the solid image. The void toner of the toner 5 shown in FIG. 5 and FIG. 6 is uncharged or low-charged toner, and the toner indicated by − (minus) is toner of which charging is regulated by the surface of the developing roller 3 and the charging layer 41 of the metal blade 4.

Figures 5A, 5B, 5C:
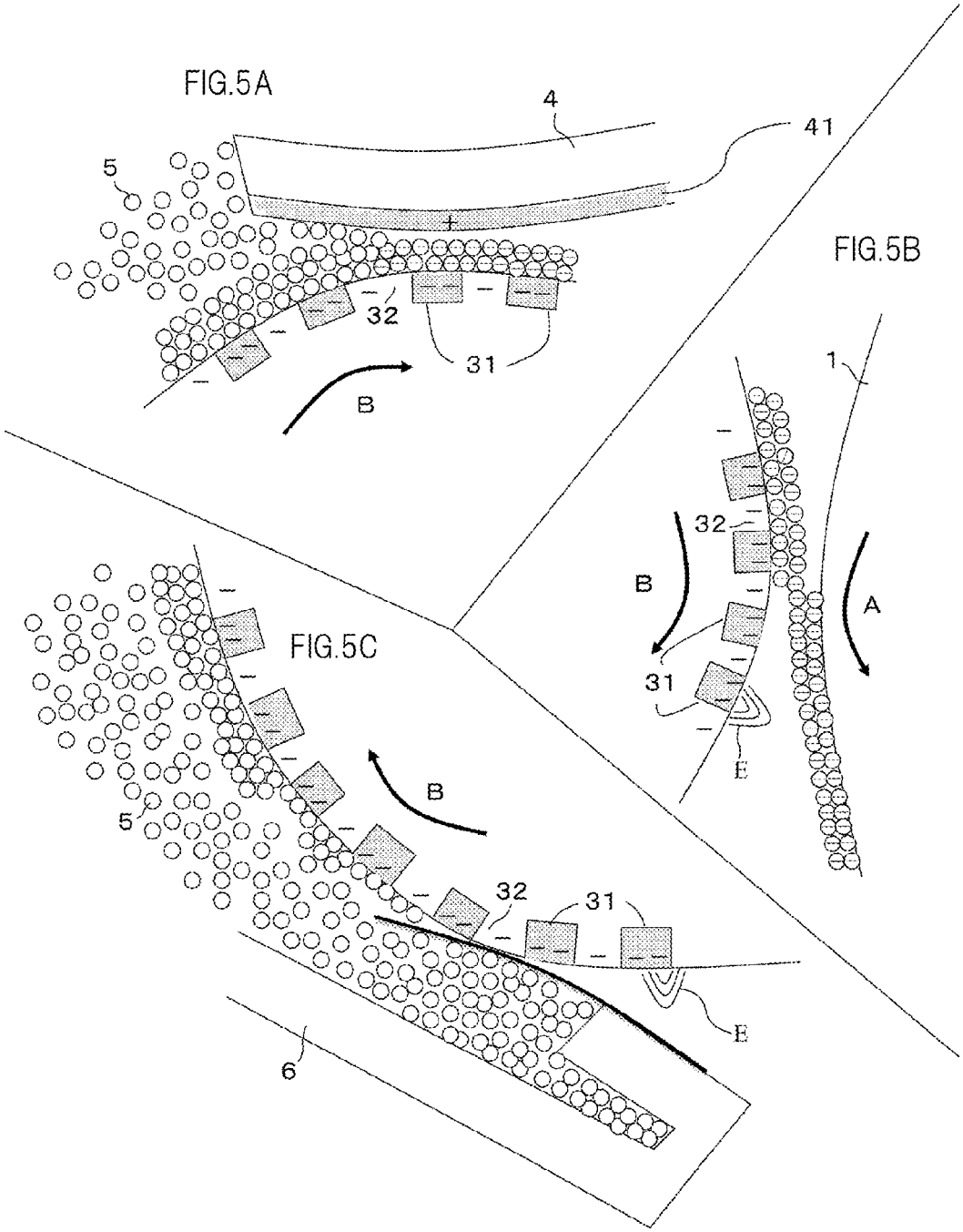
FIGS. 5A to 5C show explanatory drawings of a developing system according to Example 1 (solid image formation)

The solid image formation will be described first. By the regulating portion, the positive polarity charges are applied to the externally added particles 52, and the negative polarity charges having different absolute values are applied to the high resistance dielectric portion 31 and the intermediate dielectric portion 32, using the friction between the externally added particles 52 and the high resistance dielectric portion 31 and the intermediate resistance dielectric portion 32. Thereby the above mentioned minute closed electric field is generated between the high resistance dielectric portion 31 and the intermediate resistance dielectric portion 32. As illustrated in FIG. 5B, all the toner 5 on the developing roller 3 is developed by the developing unit. In the developer container 6, a toner layer constituted by about three layers is formed through the collection unit as illustrated in FIG. 5C by the gradient force due to the minute closed electric field generated on the developing roller 3. Then by the regulating portion, as illustrated in FIG. 5A, the toner coating amount for about two layers can always be acquired on the developing roller 3 even during solid image formation, so as to suppress the above mentioned solid image follow-up failure (details described later).

Figure 6A:
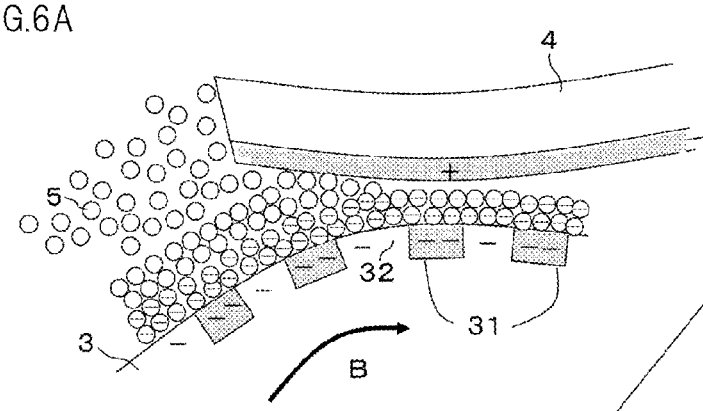
FIGS. 6A to 6C show explanatory drawings of the developing system according to Example 1 (solid white image formation)
Figure 6B:
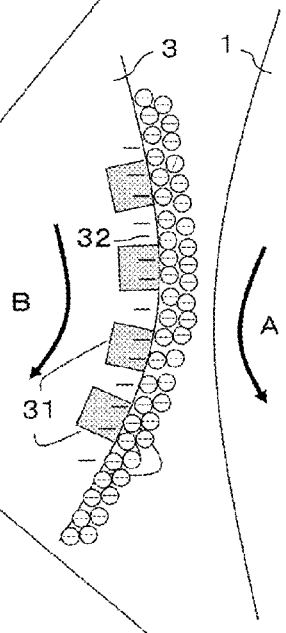
Figure 6C:
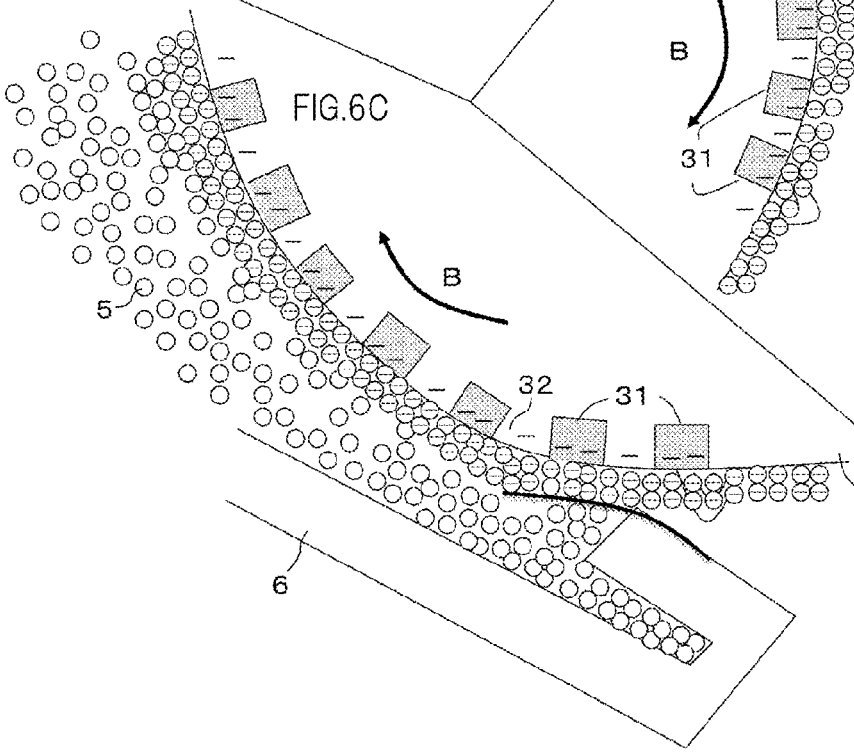

The solid white image formation will be described next. Just like the case of the solid black image formation, the above mentioned minute closed electric field is generated between the high resistance dielectric portion 31 and the intermediate resistance dielectric portion 32 by the regulating portion. Then as illustrated in FIG. 6B, all the toner 5 on the developing roller 3 is directed to the collection unit to the developer container 6 by the developing unit. In the developer container 6, a toner layer constituted by about four layers is formed through the collection unit as illustrated in FIG. 6C, by the gradient force due to the minute closed electric field generated on the developing roller 3. Then by the regulating portion, as illustrated in FIG. 6A, the toner coating amount for about two layers can be acquired on the developing roller 3 even during solid white image formation, using the regulation based on the triboelectric series difference between the developing roller 3 and the charging layer 41 of the metal blade 4, which is a characteristic of the present invention. In other words, the generation of the above mentioned ghost images can be suppressed by equalizing the toner coating amount after passing through the regulating portion when the solid image is formed, and when the solid white image is formed (details described later).

Here a ghost image suppression mechanism, which is a characteristic of the present invention, will be described in detail with reference to FIG. 7 and FIG. 8. In the toner 5 shown in FIG. 7 and FIG. 8, void toner is uncharged or low-charged, and toner indicated by – (minus) is toner charged by being regulated by the surface of the developing roller 3, the charging layer 41 of the metal blade 4, and toner 5 charged by the rotation of the surface of the developing roller 3.

Figure 7A:
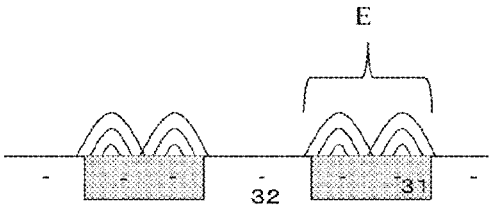
FIGS. 7A to 7F show explanatory drawings of a toner adhering mechanism according to Example 1.
Figure 7D:
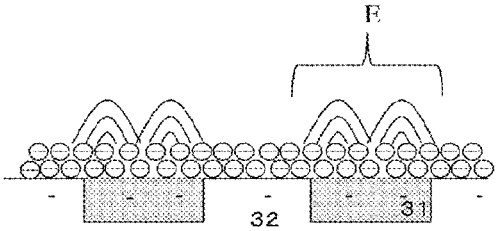
Figure 7B:
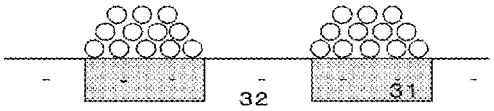
Figure 7E:
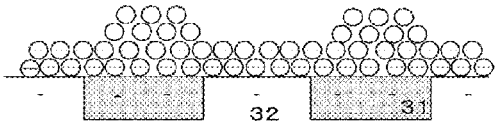
Figure 7C:
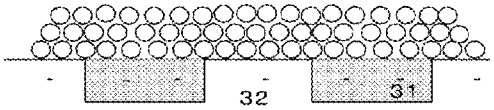
Figure 7F:
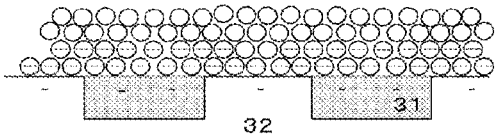

First a mechanism of the toner 5 adhering to the surface of the developing roller 3 when a solid image is formed will be described with reference to FIG. 7A, FIG. 7B and FIG. 7C, and the toner adhesion mechanism when a solid white image is formed will be described with reference to FIG. 7D, FIG. 7E and FIG. 7F. Since the toner suctioned onto the surface of the developing roller 3 in the present invention is due to the gradient force generated by the minute closed electric field, the toner 5 is subject to this force in a direction where the electric field size increases, regardless the direction of the electric field. Therefore as illustrated in FIG. 7A and FIG. 7B, the toner 5 can be suctioned if the minute closed electric field is generated, even if the polarity of the dielectric portion 31 has the same polarity as the toner 5. When the solid image is formed, the developing roller 3 returns into the developer container 6 in a state where the toner no longer exists on the surface thereof, as illustrated in FIG. 7A. At this time, the high resistance dielectric portion 31 is strongly charged to the negative polarity, and the intermediate resistance dielectric portion 32 is weakly charged to the negative polarity. As illustrated in FIG. 7B, uncharged or low-charged toner 5 is suctioned onto the surface of the high resistance dielectric portion 31 by the gradient force generated by the minute closed electric field E. At this time, the adhering toner 5 generates an unevenness on the surface of the roller, as illustrated in FIG. 7B, so as to bear the toner 5 in the gaps, and forms a toner layer constituted by about three layers, as illustrated in FIG. 7C. At this time, the toner contacting the intermediate resistance dielectric portion 32 is also charged to the negative polarity. When the solid white image is formed, on the other hand, the high resistance dielectric portion 31 is strongly charged to the negative polarity, and the intermediate resistance dielectric portion 32 is weakly charged to the negative polarity, as illustrated in FIG. 7D. The surface of the roller 3 is coated by toner having negative polarity charges, and the surface potentials of the toner layer on the high resistance dielectric portion 31 and the intermediate resistance dielectric portion 32 is shifted to the negative polarity side. Then the minute closed electric field E is generated by the potential difference between the high resistance dielectric portion 31 and the intermediate resistance dielectric portion 32 (the potential of the intermediate resistance dielectric portion 32 is higher in the negative polarity side). Then, as illustrated in FIG. 7E, the uncharged or low-charged toner 5 is suctioned by the gradient force onto the surface of the high resistance dielectric portion 32, where the minute closed electric field E is generated, generates an unevenness on the surface of the roller so as to bear the toner 5 in the gaps, and forms a toner layer constituted by about four layers, as illustrated in FIG. 7F.

Figure 8A:
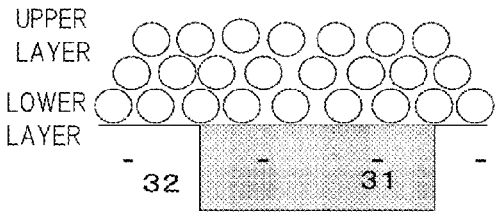
FIGS. 8A to 8F show explanatory drawings of a toner layer regulating mechanism according to Example 1.
Figure 8D:
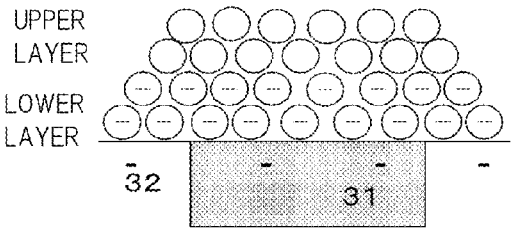
Figure 8B:
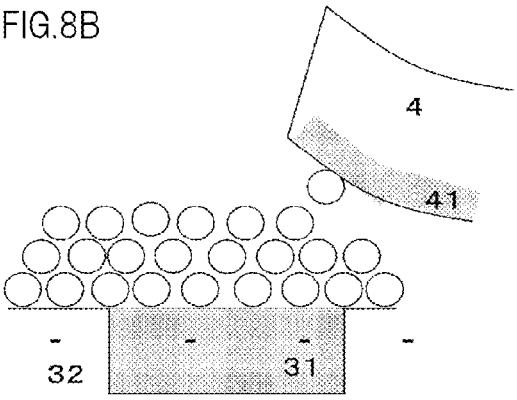
Figure 8E:
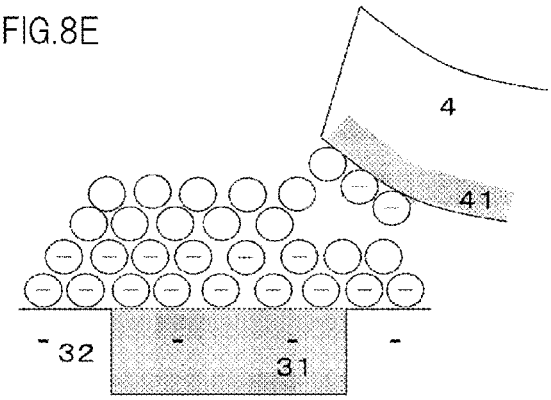
Figure 8C:
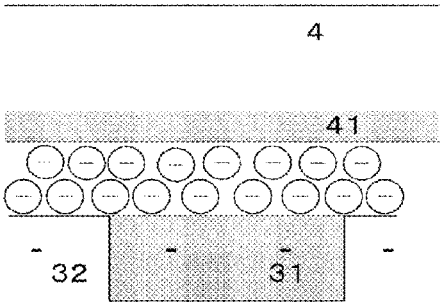
Figure 8F:
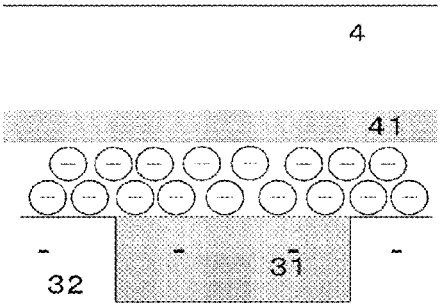
Figure 9A:
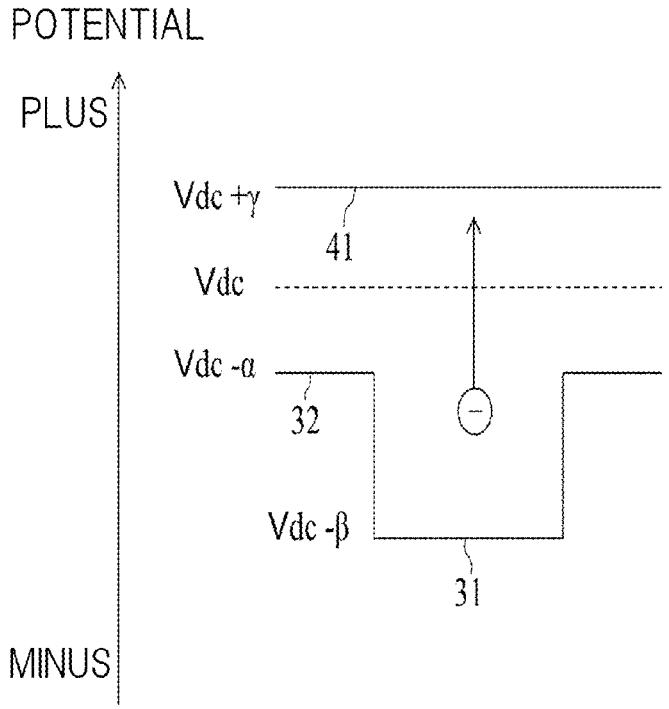
FIGS. 9A and 9B show diagrams depicting potential of the developing system according to Example 1.

Now a mechanism that regulates the toner layer on the surface of the developing roller 3 by the metal blade 4 when a solid image is formed will be described with reference to FIG. 8A, FIG. 8B and FIG. 8C, and the toner layer regulating mechanism when a solid white image is formed will be described with reference to FIG. 8D, FIG. 8E and FIG. 8F. When a solid image is formed, a toner layer constituted by about three layers is formed on the surface of the developing roller 3, as illustrated in FIG. 8A, and the toner on the upper layer, which is less restricted by the gradient force, is mechanically scraped off from the surface of the developing roller 3, as illustrated in FIG. 8B. The toner on the lower layer is conveyed to the regulating portion and is negatively charged, as illustrated in FIG. 8C. When a solid white image is formed, on the other hand, a toner layer constituted by about four layers is formed on the surface of the developing roller 3, and is regulated as illustrated in FIG. 8D. In this example, the developing assembly is constructed such that (–) colored particles 51<high resistance dielectric portion 31<intermediate resistance dielectric portion 32<charging layer 41 (+) is established in the triboelectric series. Therefore the potential relationship of the intermediate resistance dielectric portion 32, the high resistance dielectric portion 31 and the charging layer 41 is: intermediate resistance dielectric portion 32=developing bias (hereafter Vdc)$-\alpha$, high resistance dielectric portion 31=Vdc$-\beta$, and charging layer 41=Vdc$+\gamma$ ($0<\alpha<\beta$), as illustrated in FIG. 9A. Thereby as illustrated in FIG. 8E, the minus toner on the surface of the developing roller 3 can be easily scraped off from the surface of the developing roller 3, by the electric field between the charging layer 41 and the intermediate resistance dielectric portion 32/the high resistance dielectric portion 31. When the solid white image is formed, the minus toner is layered on a higher layer compared with the solid image formation, hence more toner amount is scraped off by the electric field.

In other words, according to this example, the toner coating amount after passing through the regulating portion is equalized when a solid image is formed and when a solid white is formed by the toner adhering mechanism to the surface of the developing roller 3 and the toner layer regulating mechanism described above. Thereby the generation of a ghost can be suppressed without causing a solid image follow-up failure. Here the solid image formation and the solid white image formation, where the difference in the toner coating state on the surface of the developing roller 3 is most obvious, were compared in detail, but even when a half tone image is formed, the toner coating amount after passing through the regulating portion can be equalized by the above mentioned mechanisms.

Table 1 shows a result of comparing the level of a ghost in a durability test, depending on the difference of the charging amount between the high resistance dielectric portion 31 and the intermediate resistance dielectric portion 32. In this table indicating the ghost levels, ○ indicates a level where an image problem cannot be visually recognized. Δ indicates a level where a ghost is generated in an image, but in practical terms is permissible. Here 10,000 A4 sized images were formed by the image-forming apparatus in FIG. 1, using the developing assembly of this example, and the ghost levels in the latter half of the durability test were compared. For the comparative example, the intermediate resistance dielectric portion was replaced with a conductor portion, whereby the charging amount becomes 0V. The charging amount of the high resistance dielectric portion 31 was adjusted by the size of the high resistance dielectric portion 31.

TABLE 1

| Checked Item | High resistance dielectric portion charging amount [V] | Intermediate resistance dielectric portion charging amount [V] | Ghost |
|---|---|---|---|
| Example | 20 | 10 | ○ |
| Comparative Example | 10 | 0 (Conductor) | Δ |

In this example, ghosts are suppressed somewhat compared with the comparative example. This is because the intermediate resistance dielectric portion 32 is charged to the negative polarity, which is the same as the polarity of the toner 5, and therefore the melt adhesion of the toner 5 to the developing roller 3, due to the intermediate resistance dielectric portion 32, was not generated.

As described above, according to this example, the colored particles 51, the high resistance dielectric portion 31, the intermediate resistance dielectric portion 32, the charging layer 41 and the externally added particles 52 are constituted such that the following (A) and (B) are simultaneously satisfied in the triboelectric series.

(A) (−) colored particles 51<high resistance dielectric portion 31<intermediate resistance dielectric portion 32<charging layer 41 (+)

(B) (−) colored particles 51<high resistance dielectric portion 31<intermediate resistance dielectric portion 32<externally added particles 52 (+)

Thereby in a developing assembly which does not include a developer supply member, an image-forming apparatus which considerably suppresses a ghost and solid image follow-up failure, and which achieves a long service life, can be provided.

Figure 9B:
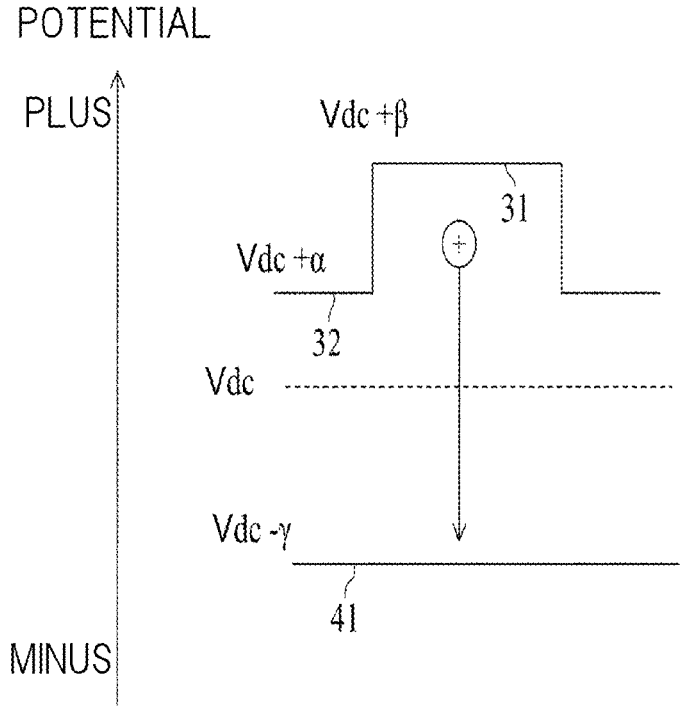

In this example, the colored particles 51, each dielectric portion 31 and 32, the charging layer 41 and the externally added particles 52 are constituted by the above mentioned materials, but the present invention is not limited to this material constitution. Any constituent material is acceptable if each dielectric portion 31 and 32 is located between the colored particles 51 and the externally added particles 52 in the triboelectric series. For example, if toner has a positive charging polarity, each constituent material is selected so that (−) externally added particles 52<intermediate resistance dielectric portion 32<high resistance dielectric portion 31<colored particles 51 (+), so that the potential relationship of the high resistance dielectric portion 31, the intermediate resistance dielectric portion 32 and the charging layer 41 can be as shown in FIG. 9B. If the difference between the high resistance dielectric portion 31 and the charging layer 41 is large in the triboelectric series, the effect of scraping the toner 5 off the developing rollers 3 by the electric field increases during regulation, and the image density may drop. In this case, an appropriate image density can be maintained by increasing the rotation speed of the developing roller.

In this example, each constituent material is selected to establish (−) colored particles 51<high resistance dielectric portion 31<intermediate resistance dielectric portion 32<charging layer 41<externally added particles 52 (+) in the triboelectric series. However this relationship in the triboelectric series need not be satisfied if the high resistance dielectric portion 31, the intermediate resistance dielectric portion 32 and the colored particles 51 are charged to the negative polarity and the charging layer 41 of the metal blade 4 is charged to the positive polarity. For example, the relationship of (−) colored particles 51<high resistance dielectric portion 31<intermediate resistance dielectric portion 32<externally added particles 52<charging layer 41 (+) may be used. The order of the charging layer 41 and the externally added particles 52 in the triboelectric series may be reversed.

The externally added particles 51 that can be suitably used for the present invention are not especially limited if only the scope of the present invention is satisfied considering the following known inorganic powders. In other words, the oxides of such metals as magnesium, zinc, aluminum, cerium, cobalt, iron, zirconium, chromium, manganese, strontium, tin and antimony; such composite metal oxides as calcium titanate, magnesium titanate and strontium titanate; such metal salts as calcium carbonate, magnesium carbonate and aluminum carbonate; such clay material as kaolin; such a phosphate compound as apatite; such silicon compounds as silicon carbide and silicon nitride; and such carbon powders as carbon black and graphite, can be used if the scope of the present invention is satisfied.

In this example, the roughness of the developing roller 3 is not mentioned, but the toner conveyance performance can be controlled by the surface roughness of the developing roller 3, so as to increase the effect of suppressing a ghost and solid image follow-up failure.

The developing roller 3 according to this example has a configuration where a plurality of high resistance dielectric portions 31 are scattered on the surface of the layer of the intermediate resistance dielectric portion 32. Here "scattered" not only refers to the state where each high resistance dielectric portion 31 is separated from each other, but also includes a state where a part of the high resistance dielectric portions 31 are in contact with each other, as illustrated in FIG. 3B. In other words, required here is that the high resistance dielectric portions 31 are regularly or irregularly distributed at a certain ratio to the entire surface of the intermediate resistance dielectric portion 32, without clustering in one area. In FIG. 3B, the intermediate resistance dielectric portion 32 corresponds to a sea in a sea-island model, and the high resistance dielectric portions 31 corresponds to islands thereof. A reversed configuration, that is a configuration where a plurality of islands of the intermediate resistance dielectric portions 32 are located in a sea of the high resistance dielectric portion 31 may be used instead.

Figure 10:
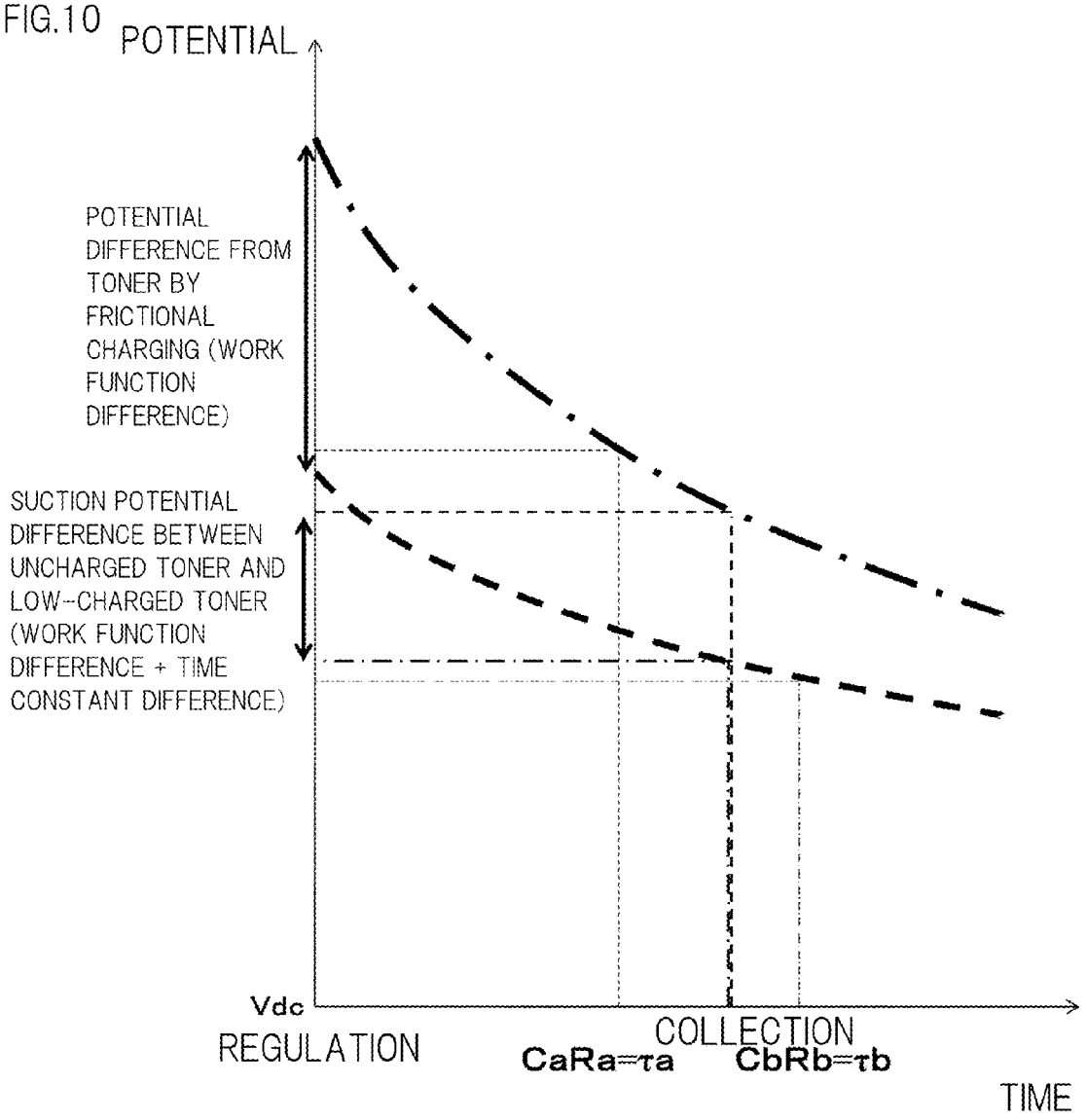
FIG. 10 is a diagram for explaining the relationship between the potential of the developing roller dielectric portion and time according to Example 1.

In this example the high resistance dielectric material and the intermediate resistance dielectric material are selected so that the difference of the work functions between the externally added particles 52 and the high resistance dielectric portion 31 is greater than the difference of the work functions between the externally added particles 52 and the intermediate resistance dielectric portion 32, and the relationship RaCa>RbCb is satisfied. Therefore the potential charged on each dielectric portion decays along the curve shown in FIG. 4. However as a configuration to demonstrate the effect of the present invention, it is also acceptable that the difference of the work functions between the externally added particles 52 and the high resistance dielectric portion 31 is greater than the difference of the work functions between the externally added particles 52 and the intermediate resistance dielectric portion 32, and RbCb>RaCa is established (FIG. 10). In other words, it is also acceptable that the time constant RaCa of the high resistance dielectric portion is small, and the decay of the potential of the high resistance dielectric portion is faster than the decay of the potential of the intermediate resistance dielectric portion. In this case, however, it is preferable that the difference between the potential of the high resistance dielectric portion and the potential of the intermediate resistance dielectric portion is increased in advance in the regulating portion. This is because the absolute value of the potential of the high resistance dielectric portion is maintained to be greater than the absolute value of the potential of the intermediate resistance dielectric portion from the regulating portion to the collection position.

EXAMPLE 2

An image-forming apparatus according to Example 2 of the present invention will be described with reference to FIG. 11 and FIG. 12. Here only the differences from Example 1 will be described, and a same composing element as Example 1 is denoted with a same reference symbol, for which description is omitted. Matters not described here are the same as Example 1.

Figure 11:
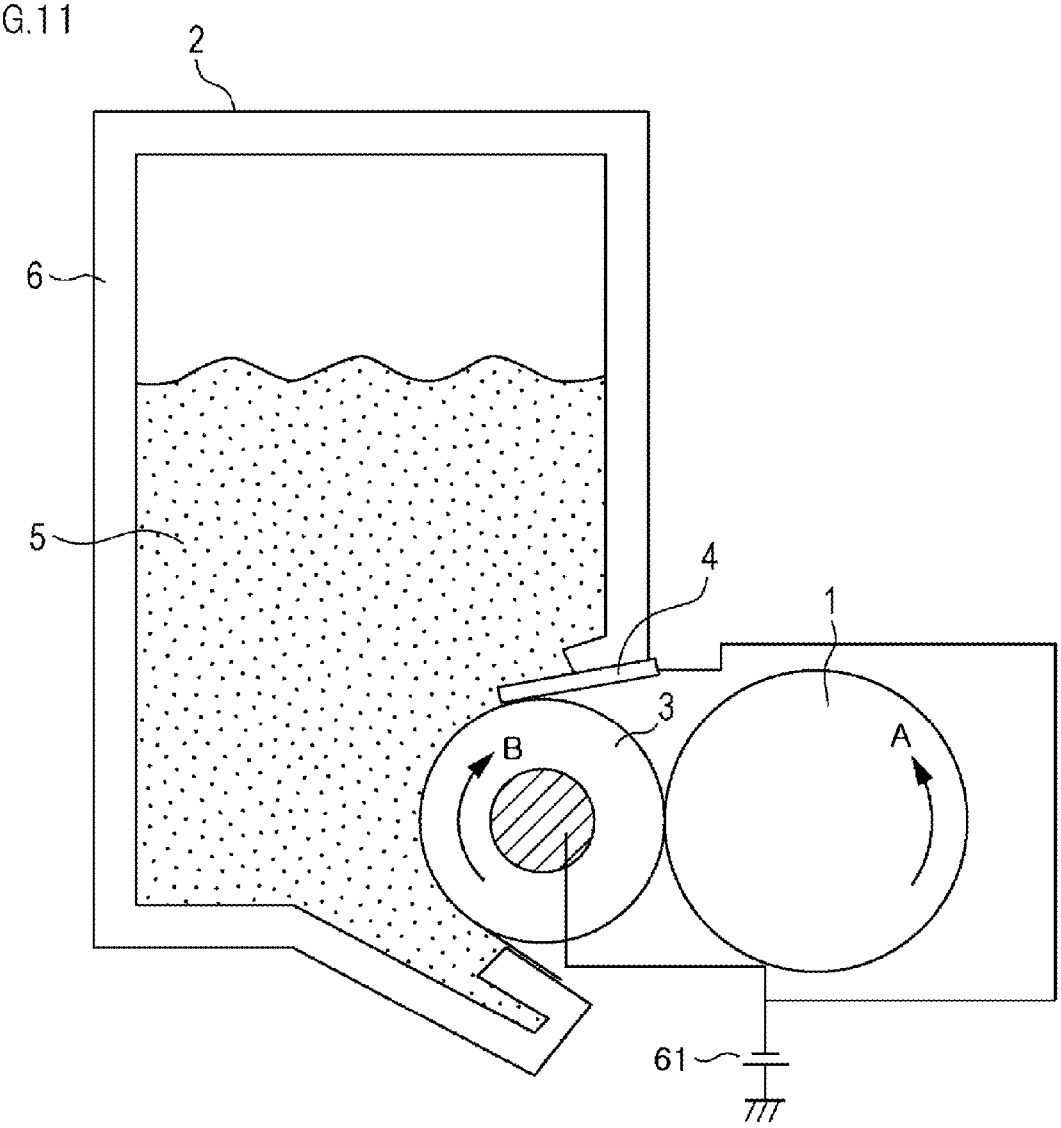
FIG. 11 is a schematic cross-sectional view of a developing assembly according to Example 2.

Unlike the developing assembly 2 of Example 1, the image-forming apparatus according to this example has no charging layer 41 of the metal blade 4, so that toner coating amount on the surface of the developing roller 3 is controlled by applying the blade bias on the metal blade 4, as illustrated in FIG. 11.

In this example, the electric field where toner is scraped off from the high resistance dielectric portion 31 and the intermediate resistance dielectric portion 32 is formed by the blade bias, hence the potential of each dielectric portion during image formation must be accurately detected. The potential of each dielectric portion in this example is measured according to the following procedure.

(1) The developing roller 3 is removed after a solid white image is formed, and a measurement sample, of which surface is 1 cm×1 cm and thickness is 3 mm, is cut out from the developing roller 3.

(2) The potential values of the high resistance dielectric portion 31 and the intermediate resistance dielectric portion 32 are measured in KFM mode by a scanning probe microscope (SPA 300 made by SII Nanotechnology Corporation) for 30 minutes after image formation ends.

(3) Decay of the potential for 30 minutes is calculated based on the specific dielectric constant and the resistivity of the high resistance dielectric portion 31 and the intermediate resistance dielectric portion 32 respectively, and potential values when the image is formed is determined.

In this example, the potential values of the high resistance dielectric portion 31 and the intermediate resistance dielectric portion 32 measured in the above mentioned (2) are −20V and −2.5V respectively. The high resistance dielectric portion 31 (acrylic resin particles) used for this example has: specific dielectric constant=3.5, resistivity=1E+15 (Ω·m), and potential decay rate=6%, therefore the potential of the high resistance dielectric portion 31 during image formation is −21.2V. The intermediate resistance dielectric portion 32 (urethane) has: specific dielectric constant=7, resistivity=2E+13 (Ω·m), and potential decay rate=76%, therefore the potential of the intermediate resistance dielectric portion 32 during image formation is 10.7V.

In this example as well, just like Example 1, the colored particles 51 are charged to negative polarity, and the externally added particles 52 are charged to positive polarity, but the toner 5 behaves as negative polarity particles since the parts by mass of the colored particles 51 are sufficiently larger compared with the parts by mass of the externally added particles 52.

[Table 2] shows a result of forming an image by applying blade bias from the high voltage power supply 61 as the voltage applying unit to the metal blade 4. In this table indicating the ghost and density levels, ○ indicates a level where an image problem cannot be visually recognized, Δ indicates a level where a problem is generated in an image but in practical terms is permissible. X indicates a level where a problem is generated in an image, and in practical terms is unacceptable. In this example, the toner 5 having negative charging polarity is used, hence if the blade bias is applied to the developing roller in a more plus direction than the potential of the intermediate resistance dielectric portion 32, the electric field is generated in the direction where the toner 5 moves from the surface of the developing roller 3 to the metal blade 4*b*.

TABLE 2

| Blade bias to developing roller [V] | Ghost | Density |
|---|---|---|
| −50 | X | ○ |
| −20 | X | ○ |
| −10 | Δ | ○ |
| 0 | ○ | ○ |
| 100 | ○ | Δ |

As Table 2 shows, ghost images are suppressed by changing the blade bias to the developing roller from minus to plus. The mechanism of suppressing a ghost image is the same as Example 1, that is, scraping the upper layer tone in FIG. 8B and FIG. 8E by the electric field generated by the blade bias to the developing roller. In this example, the high resistance dielectric portion 31 and the intermediate resistance dielectric portion 32 are charged to the same polarity (−) as the toner 5, therefore the potential of the intermediate resistance dielectric portion 32 makes it more difficult to implement scraping by the electric field. Hence by setting the blade bias to the developing roller to the more plus side from −10V, which is the charging amount of the intermediate resistance dielectric portion 32, an electric field for scrapping is generated in the toner on the surface of the developing roller 3, and ghost images are considerably suppressed. Further, increasing the blade bias to the developing roller to the plus side increases the effect of scraping off the toner on the developing roller 3 by the electric field, and decreases the image density, but an appropriate image density can be maintained by increasing the rotation speed of the developing roller.

Figure 12A:
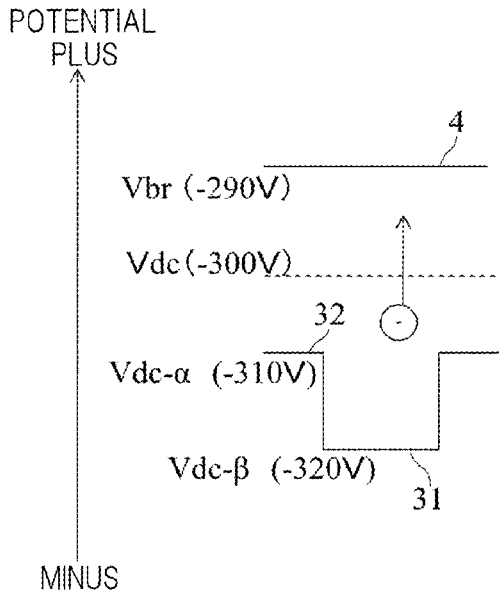
FIGS. 12A to 12D show diagrams depicting potential of the developing system according to Example 2.
Figure 12B:
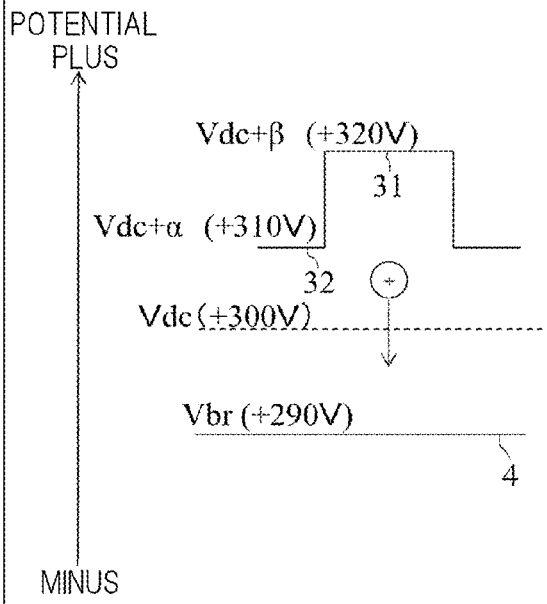
Figure 12C:
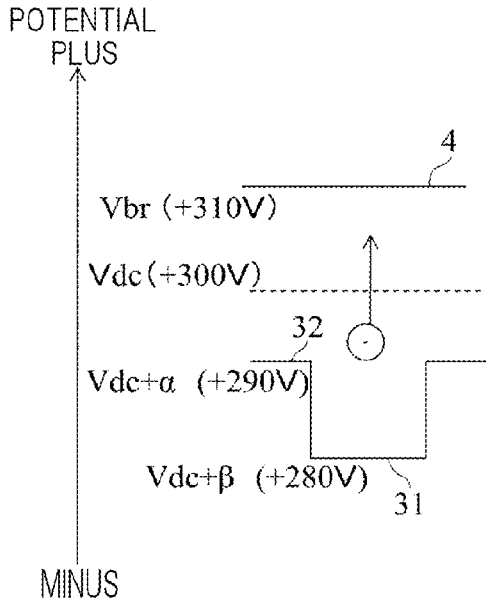
Figure 12D:
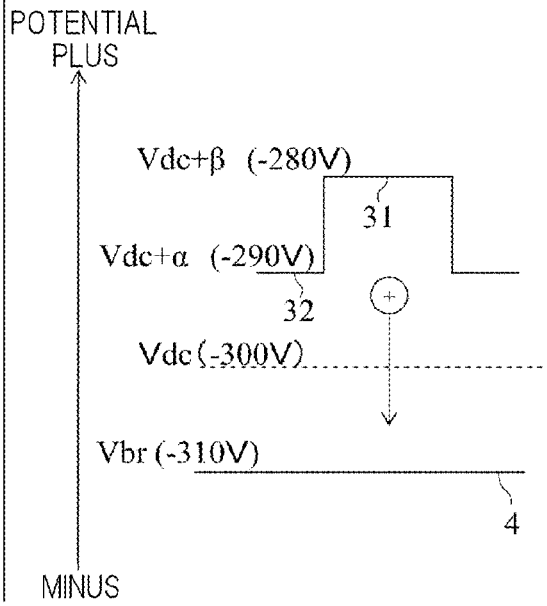

FIG. 12A shows a diagram depicting the potentials of the intermediate resistance dielectric portion 32, the high resistance dielectric portion 31 and the metal blade 4 according to this example, and FIG. 12B, FIG. 12C and FIG. 12D show diagrams depicting this according to the modifications of this example. FIG. 12A is a case when the toner 5 has negative polarity, and the developing bias is negative polarity, that is the potential relationship shown in this example is established, and in this case, the electric field to scrape off the toner 5 from the dielectric portion 32 is generated. FIG. 12B shows a case when the toner 5 has positive polarity, and the developing bias is positive polarity, FIG. 12C shows a case when the toner 5 has negative polarity, and the developing bias is positive polarity, and FIG. 12D shows a case when the toner 5 has positive polarity, and the developing bias is negative polarity.

The mechanism of suppressing melt adhesion of the toner to the high resistance dielectric portion 31 and the intermediate resistance dielectric portion 32, caused by an increase in the number of images to be formed, is the same as Example 1.

10,000 A4 sized images were formed using an image-forming apparatus equipped with the developing assembly in FIG. 11 according to this example, with setting the potential values of the intermediate resistance dielectric portion 32, the high resistance dielectric portion 31 and the metal blade 4 as shown in FIG. 12A. This resulted in obtaining satisfactory images while maintaining appropriate image density and without generating image problems. The level in the durability test was similar to the result of Table 1 of Example 1.

According to this example, minute areas of the high resistance dielectric portion 31 and those of the intermediate resistance dielectric portion 32 are mixed and exposed on the surface of the developing roller 3, and the absolute values of the intermediate resistance dielectric portion 32, the high resistance dielectric portion 31 and the metal blade 4 are set to have the above mentioned relationship. Thereby in a developing assembly which does not include a developer supply member, an image-forming apparatus which considerably suppresses ghosts and solid image follow-up failures, and which achieves a long service life, can be provided.

In this example, the roughness of the developing roller 3 is not mentioned, but the toner conveyance performance can be controlled by the surface roughness of the developing roller 3 so as to increase the effect of suppressing ghosts and solid image follow-up failures.

The effects mentioned in the above examples are summarized as follows. That is, according to the configuration of each example, the image-forming apparatus can form more satisfactory images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-173702, filed Aug. 23, 2013 which is hereby incorporated by reference herein in its entirety.

What is claimed is:

1. A developing assembly, comprising:

a container that contains developer including colored particles and externally added particles dispersed on the surface of the colored particles;

a developer bearing member that bears the developer; and a regulating portion that regulates a layer thickness of the developer borne by the developer bearing member, wherein a first dielectric portion and a second dielectric portion are disposed on a surface of the developer bearing member bearing the developer, and the regulating portion, the first dielectric portions and the second dielectric portion have the following relationships:

concerning charging polarity, the first dielectric portion and the second dielectric portion have a same polarity as the colored particles, and the regulating portion and the externally added particles have opposite polarities;

concerning triboelectric series, the second dielectric portion is located between the colored particles and the first dielectric portion, and the first dielectric portion is located between the second dielectric portion and the externally added particles, and the second dielectric portion is located between the colored particles and the first dielectric portion, and the first dielectric portion is located between the second dielectric portion and the regulating portion; and concerning work functions, the difference between the colored particles and the second dielectric portion is smaller than the difference between the second dielectric portion and the externally added particles, the difference between the colored particles and the first dielectric portion is smaller than the difference between the first dielectric portion and the externally added particles, and the difference between the colored particles and the regulating portion is greater than the difference between the regulating portion and the externally added particles.

2. The developing assembly according to claim 1, wherein the first dielectric portion and the second dielectric portion are constituted by materials having different work functions respectively.

3. The developing assembly according to claim 1, wherein the difference of the work functions between the externally added particles and the second dielectric portion is greater than the difference of the work functions between the externally added particles and the first dielectric portion, and the first dielectric portion and the second dielectric portion are configured so as to satisfy $RaCa>RbCb$, where Ra is an electric resistance value and Ca is an electrostatic capacitance of the first dielectric portion, and Rb is an electric resistance value and Cb is an electrostatic capacitance of the second dielectric portion.

4. The developing assembly according to claim 1, wherein the first dielectric portion and the second dielectric portion are formed on the surface of a conductive substrate.

5. The developing assembly according to claim 1, wherein the surface bearing the developer is configured so that second dielectric portions are scattered on the surface constituted by the first dielectric portion.

6. The developing assembly according to claim 1, configured to be detachable from an apparatus main body of an image-forming apparatus.

7. A process cartridge detachable from an apparatus main body of an image-forming apparatus, comprising:

a developing assembly; and an image bearing member that bears an electrostatic latent image, wherein the developing assembly comprises:

a container that contains developer including colored particles and externally added particles dispersed on the surface of the colored particles;

a developer bearing member that bears the developer; and a regulating portion that regulates a layer thickness of the developer borne by the developer bearing member, a first dielectric portion and a second dielectric portion are disposed on a surface of the developer bearing member bearing the developer, and wherein the regulating portion, the first dielectric portion, and the second dielectric portion have the following relationships:

concerning charging polarity, the first dielectric portion and the second dielectric portion have a same polarity as the colored particles, and the regulating portion and the externally added particles have opposite polarities;

concerning triboelectric series, the second dielectric portion is located between the colored particles and the first dielectric portion, and the first dielectric portion is located between the second dielectric portion and the externally added particles, and the second dielectric portion is located between the colored particles and the first dielectric portion, and the first dielectric portion is located between the second dielectric portion and the regulating portion; and concerning work functions, the difference between the colored particles and the second dielectric portion is smaller than the difference between the second dielectric portion and the externally added particles, the difference between the colored particles and the first dielectric portion is smaller than the difference between the first dielectric portion and the externally added particles, and the difference between the colored particles and the regulating portion is greater than the difference between the regulating portion and the externally added particles.

8. The process cartridge according to claim 7, wherein the first dielectric portion and the second dielectric portion are constituted by materials having different work functions respectively.

9. The process cartridge according to claim 7, wherein the difference of the work functions between the externally added particles and the second dielectric portion is greater than the difference of the work functions between the externally added particles and the first dielectric portion, and the first dielectric portion and the second dielectric portion are configured so as to satisfy RaCa>RbCb, where Ra is an electric resistance value and Ca is an electrostatic capacitance of the first dielectric portion, and Rb is an electric resistance value and Cb is an electrostatic capacitance of the second dielectric portion.

10. The process cartridge according to claim 7, wherein the first dielectric portion and the second dielectric portion are formed on the surface of a conductive substrate.

11. The process cartridge according to claim 7, wherein the surface bearing the developer is configured so that second dielectric portions are scattered on the surface constituted by the first dielectric portion.

12. An image-forming apparatus that forms an image on a recording medium, comprising:

a developing assembly;

an image bearing member that bears an electrostatic latent image; and a voltage applying unit, wherein the developing assembly comprises:

a container that contains developer including colored particles and externally added particles dispersed on the surface of the colored particles;

a developer bearing member which bears the developer and to which voltage is applied by the voltage applying unit; and a regulating portion that regulates a layer thickness of the developer borne by the developer bearing member, a first dielectric portion and a second dielectric portion are disposed on a surface of the developer bearing member bearing the developer, and wherein the regulating portion, the first dielectric portion, and the second dielectric portion have the following relationships:

concerning charging polarity, the first dielectric portion and the second dielectric portion have a same polarity as the colored particles, and the regulating portion and the externally added particles have opposite polarities;

concerning triboelectric series, the second dielectric portion is located between the colored particles and the first dielectric portion, and the first dielectric portion is located between the second dielectric portion and the externally added particles, and the second dielectric portion is located between the colored particles and the first dielectric portion, and the first dielectric portion is located between the second dielectric portion and the regulating portion; and concerning work functions, the difference between the colored particles and the second dielectric portion is smaller than the difference between the second dielectric portion and the externally added particles, the difference between the colored particles and the first dielectric portion is smaller than the difference between the first dielectric portion and the externally added particles, and the difference between the colored particles and the regulating portion is greater than the difference between the regulating portion and the externally added particles.

13. The image-forming apparatus according to claim 12, wherein the first dielectric portion and the second dielectric portion are constituted by materials having different work functions respectively.

14. The image-forming apparatus according to claim 12, wherein the difference of the work functions between the externally added particles and the second dielectric portion is greater than the difference of the work functions between the externally added particles and the first dielectric portion, and the first dielectric portion and the second dielectric portion are configured so as to satisfy RaCa>RbCb, where Ra is an electric resistance value and Ca is an electrostatic capacitance of the first dielectric portion, and Rb is an electric resistance value and Cb is an electrostatic capacitance of the second dielectric portion.

15. The image-forming apparatus according to claim 12, wherein the first dielectric portion and the second dielectric portion are formed on the surface of a conductive substrate.

16. The image-forming apparatus according to claim 12, wherein the surface bearing the developer is configured so that second dielectric portions are scattered on the surface constituted by the first dielectric portion.

17. The image-forming apparatus according to claim 12, further comprising a second voltage applying unit that applies voltage to the regulating portion.

* * * * *